United States Patent [19]

Dean, Jr. et al.

[11] Patent Number: 4,505,654

[45] Date of Patent: Mar. 19, 1985

[54] ROTARY VANE DEVICE WITH TWO PRESSURE CHAMBERS FOR EACH VANE

[75] Inventors: Laurence C. Dean, Jr., Lake Orion; Louis J. Cardinale, Utica, both of Mich.

[73] Assignee: Vickers Incorporated, Troy, Mich.

[21] Appl. No.: 528,416

[22] Filed: Sep. 1, 1983

[51] Int. Cl.[3] ..... F01C 1/00; F01C 19/08

[52] U.S. Cl. ..... 418/80; 418/82; 418/133; 418/268

[58] Field of Search ..... 418/80, 82, 133, 268

[56] References Cited

U.S. PATENT DOCUMENTS

| | | | |
|---|---|---|---|
| 2,967,488 | 1/1961 | Gardiner | 418/81 |
| 3,102,494 | 9/1963 | Adams | 418/268 |
| 3,645,654 | 2/1972 | Niemiec et al. | 418/133 |

*Primary Examiner*—John J. Vrablik

*Attorney, Agent, or Firm*—Barnes, Kisselle, Raisch, Choate, Whittemore & Hulbert

[57] ABSTRACT

A fluid pressure energy translating device of the sliding vane type comprising a cam ring including an internal contour, a rotor having a plurality of vanes rotatable therewith and slidable relative thereto in slots in the rotor with one end of each vane engaging the internal contour. The rotor and internal contour cooperate to define one or more pumping chambers between the periphery of the rotor and the cam contour through which the vanes pass carrying fluid from an inlet port to an outlet port. At least one cheek plate is associated with the body and rotor. Two pressure chambers are formed for each vane and each vane has two surfaces, one in each chamber, both being effective under pressure in the respective chambers to urge the vanes into engagement with the cam. A generally annular internal feed passage is formed entirely within the rotor and communicates with one set of the pressure chambers. A radial passage is provided on each vane extending from the tip of the base thereof, so that cyclically changing pressure is supplied to the other set of chambers. Arcuate grooves are provided in the face of the cheek plate in the dwell zones, and a hydrostatic pressure pad is associated with the opposite face of the cheek plate and circumscribes the arcuate grooves. An opening extends from the arcuate grooves through the cheek plate to the hydrostatic area.

3 Claims, 9 Drawing Figures

ROTARY VANE DEVICE WITH TWO PRESSURE CHAMBERS FOR EACH VANE

This invention relates to power transmissions and particularly to fluid pressure energy translating devices such as pumps or motors.

BACKGROUND AND SUMMARY OF THE INVENTION

A form of pump and motor utilized in hydraulic power transmission comprises a rotor having a plurality of spaced radial vanes rotatable therewith and slidable relative thereto in slots provided in the rotor. The rotor and vanes cooperate with the internal contour of a cam to define one or more pumping chambers between the outer periphery of the rotor and the cam contour through which the vanes pass carrying fluid from an inlet port to an outlet port. Cheek plates are associated with each side of the cam and rotor through which the fluid flows to and from the rotor.

It has heretofore been recognized that it is essential for efficient operation of the pump to apply pressure to a chamber at the underside of the vanes in order to maintain them in contact with the cam. In the past pressure has been applied continuously or intermittently to the undersides of the vanes. In the continuous pressure arrangement pressure is applied even when the vanes are in low pressure zones and has resulted in excessive cam and vane tip wear. In the intermittent pressure arrangement, pressure is applied to the vanes only when the vanes are in high pressure zones and only centrifugal force is utilized to urge the vanes toward the cam when the vanes are in low pressure zones. As a result the contact of the vanes with the cam is not positive during some portions of the travel so that efficiency is adversely affected.

It has heretofore been suggested and commercial devices have been made wherein additional pressure chambers are associated with each vane. The chamber at the base of each vane is commonly known as the under vane chamber and is subjected to cyclically changing pressure. The additional chambers are commonly known as the intra-vane chambers and are subjected to continuous high pressure. Typical devices are shown in U.S. Pat. Nos. 2,919,651 and 2,967,488. In such an arrangement, the contact of the vanes with the cam is controlled at all times by fluid pressure to the intra-vane and under vane chambers.

It has also heretofore been suggested that the intra-vane chambers be fed with fluid through an internal passage formed entirely within the rotor and that a check valve be associated with each vane to control the flow of fluid to the chambers. A typical arrangement of this type is shown in U.S. Pat. No. 3,223,044.

In application Ser. No. 275,948 filed June 22, 1981 now U.S. Pat. No. 4,431,389, having a common assignee with the present application, there is disclosed a device having a generally annular internal feed passage formed entirely within the rotor and communicating with the intra-vane chambers. A radial passage along each side of each vane extends from the outer end or tip of each vane to the inner end or base of each vane thereof to supply cyclically changing fluid pressure to the under vane chambers. An arcuate valving groove is formed in each cheek plate alongside the rotor in the pressure zones and communicates with the radial passages as the rotor rotates. Axial openings in the sides of the rotor extend to and intersect the annular passage. The axial openings are adapted to register with the arcuate groove as the rotor rotates relative to the cheek plates to supply fluid under pressure from the radial passages in the vanes through the arcuate grooves and axial openings to the annular passage and, in turn, to the intra-vane chambers.

In such a construction, as the size of the pump or motor increases, it becomes more difficult to balance the pressures on the cheek plates because of the fact that in the dwell zones, the vane chambers change rapidly from high to low pressures causing a non-uniformity of pressure on the cheek plates.

Accordingly, among the objectives of the present invention are to provide a fluid energy translating device which has improved pressure balancing.

In accordance with the invention, arcuate grooves are provided in the face of the cheek plate concentric with the arcuate valving groove and openings extend through the cheek plate to a hydrostatic pressure area that has an arcuate extent circumscribing the dwell zone and the arcuate valving groove on the face of the cheek plate.

DESCRIPTION

Figure 1:
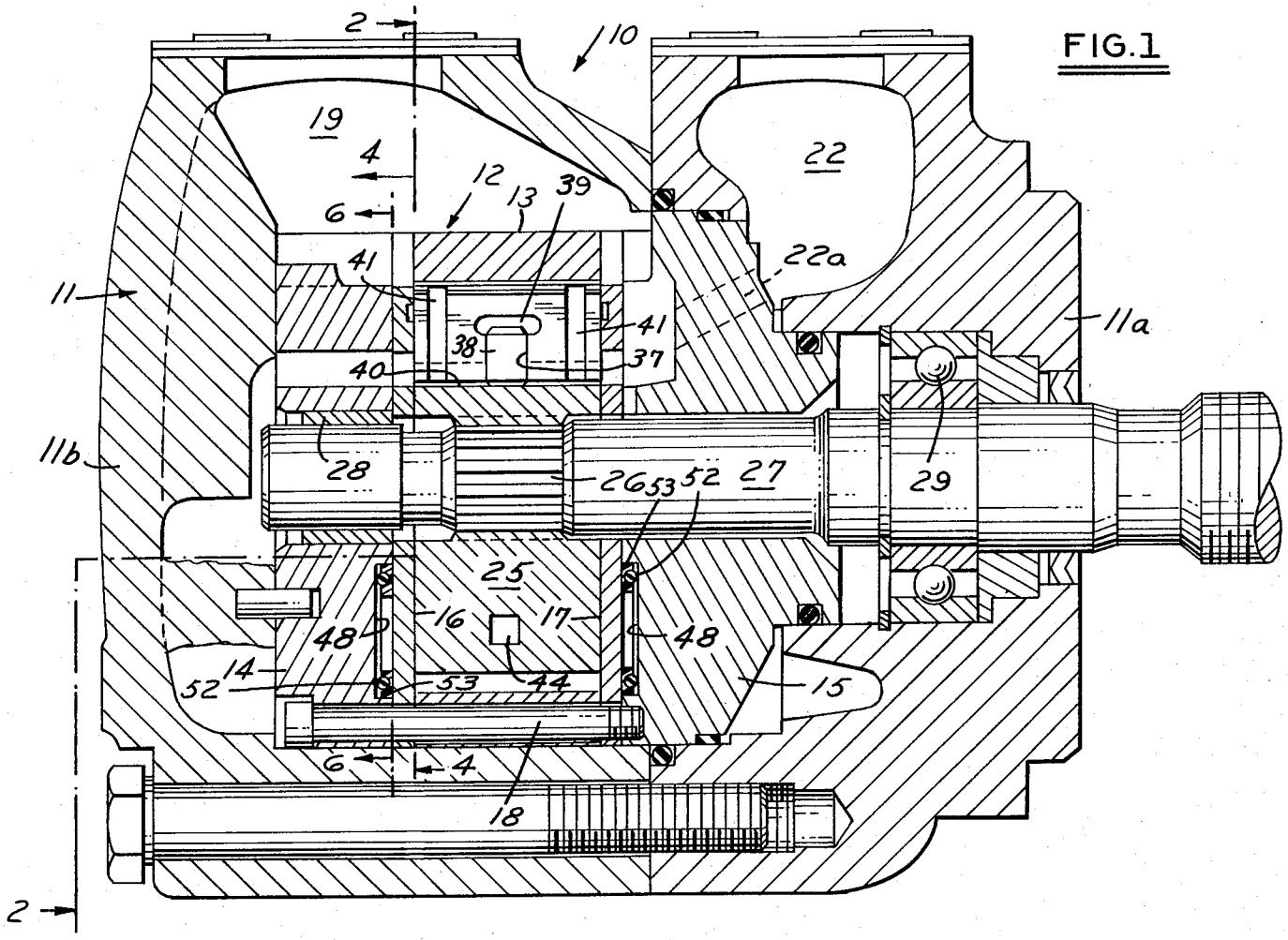
FIG. 1 is a longitudinal sectional view through a pump embodying the invention taken along the line 1—1 in FIG. 2.
Figure 2:
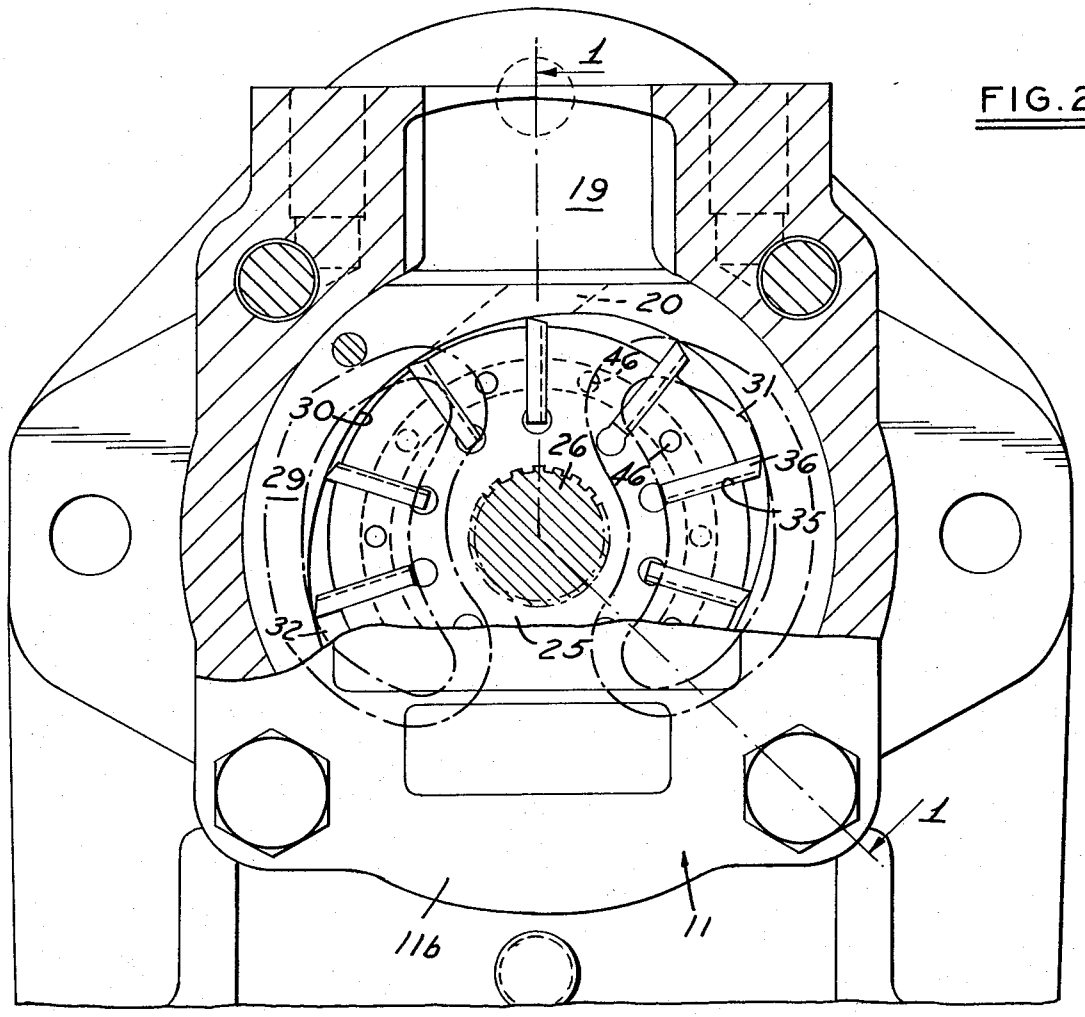
FIG. 2 is a sectional view taken along the line 2—2 in FIG. 1.
Figure 4:
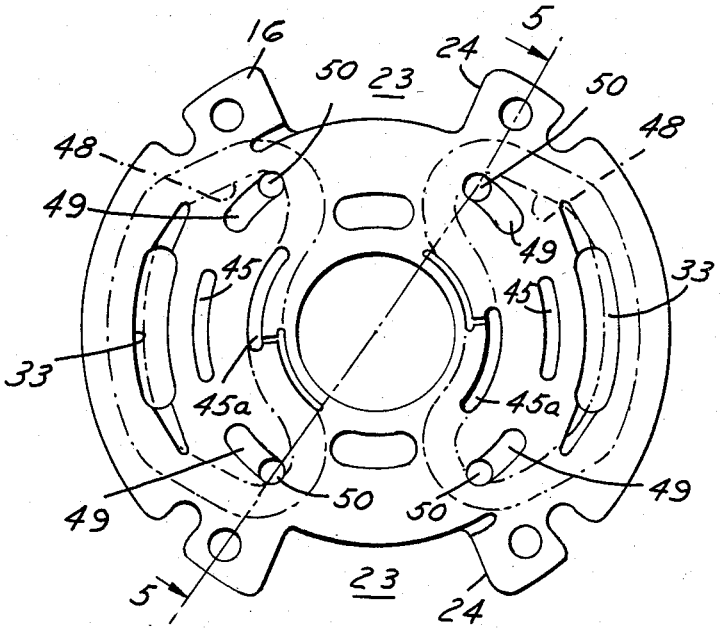
FIG. 4 is a view of a cheek plate of the pump taken along the line 4—4 in FIG. 1.

Referring to FIGS. 1 and 2, there is shown a rotary sliding vane device or pump 10 comprising a casing 11 and a cartridge or subassembly 12. Casing 11 comprises a body **11*a* and a cover 11*b*. The cartridge 12 includes a cam ring 13 sandwiched between support plates 14, 15 with intermediate cheek plates 16, 17 all of which are secured to each other by bolts 18 extending through support plate 14 and cam 13 into threaded holes in support plate 15. The cover 11*b* is provided with an inlet supply connection port 19 leading into a pair of fluid port inlet openings 20, in cam 13 as shown in FIG. 2 and passages 23 formed by recesses 24 in the cheek plates as shown in FIG. 4**.

An outlet connection port 22 is provided in the body **11*a* which is directly connected by a passage 22*a* to a pressure delivery chamber formed in support plate 15**.

A rotor 25 is rotatably mounted within the cam 13 on the splined portion 26 of a shaft 27 which is rotatably mounted within a bearing 28 in the support plate 14 and a bearing 29 mounted within the body **11*a***.

Cam 13 has an internal contour 30 which is substantially oval in shape and which together with the periphery of the rotor 25 and the adjoining surfaces of the cheek plates 16, 17 define two opposed pumping chambers 31, 32 each of which has fluid inlet and fluid outlet zones. The fluid inlet zones comprise those portions of the pumping chambers 31, 32, respectively, registering with the fluid inlet port openings 20 and cheek plate passages 23. The fluid delivery zones comprise those portions of the pumping chambers 31, 32 registering, respectively, with opposed arcuately shaped fluid delivery port openings 33 in cheek plates 16, 17 which are directly connected to the outlet connection port 22. Fluid flows to the inlet zones through inlet port openings 20 and also through the passages 23 formed by recesses 24 in the cheek plates 16, 17 which permit the fluid to flow from the inlet 19 between the sides of cam 13 and the respective supporting plates 14, 15.

The pumping device so far described is of the well known structure disclosed in the U.S. Pat. No. 2,967,488. It has been the practice in devices of this type to provide the rotor with a plurality of radial vane slots 35, each of which has a vane 36 slidably mounted therein. The outer end or vane tip of vanes 36 engage the inner contour of cam 13. The contour of cam 13 includes an inlet rise portion, an intermediate arc portion, an outlet fall portion, and another arc portion. The cam contour is symmetrical about its minor axis, thus each of the rise, fall and arc portions are duplicated in the other opposed portion of the contour. As the tips of vanes 36 carried by the rotor 25 transverse the inlet rise portions, the vanes 36 move radially outward with respect to the rotor 25, and when the vane tips traverse the outlet fall portions, the vanes 36 move radially inward. The spacing between each pair of vanes 36 is adapted to span the distance between each pair of ports in a manner to provide proper sealing between the inlet and outlet chambers of the pumping device.

Each vane 36 has a rectangular notch 37 extending from the inner end or base of the vane to substantially the mid-section thereof. A reaction member 38 comprises a flat sided blade substantially equal in width and thickness to that of the notch 37 in the vane so as to have a sliding fit within the vane and the side walls of each rotor vane slot 35. The side walls of the rotor vane slot 35, the vane 36 and the reaction member 38 define an expansible intra-vane chamber 39. An under vane pressure chamber 40 is defined by the base of each vane 36 and the base and side walls of each rotor vane slot 35. Chambers 39 and 40 are separated by and sealed from each other by reaction member 38. Thus, the two chambers 39, 40 are provided substantially the same as shown in U.S. Pat. No. 2,967,488 which is incorporated herein by reference.

Figure 3:
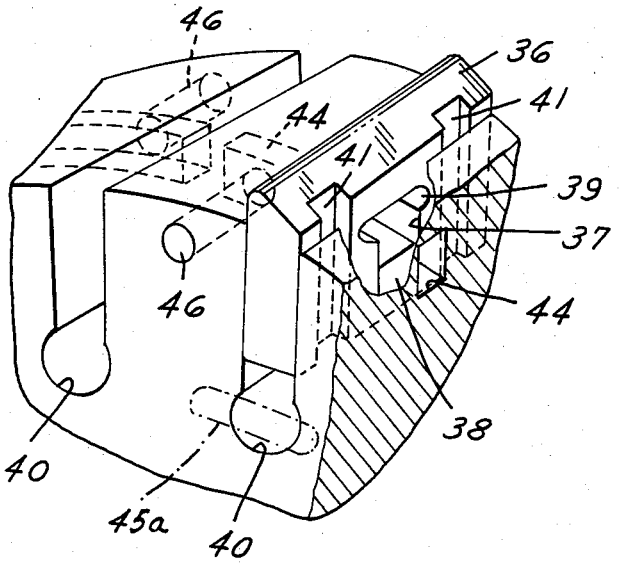
FIG. 3 is a fragmentary perspective view of a portion of a pump embodying the invention.

Referring to FIG. 3, the under vane chamber 40, associated with the base of each vane 36, is provided with fluid pressure by radial passages 41 on each vane 36 spaced from the side edges of the vane. Passages 41 are defined by grooves formed in the vane. The radial passages 41 transmit fluid to the under vane chambers 40 and, thus, to the bases of the vanes 36. Thus, the cyclically changing pressure which is exerted on the tips of the vanes 36 as they traverse the inlet and outlet portions of the cam contour is transmitted to the bases of the vanes 36.

An annular closed passage 44 entirely within rotor 25 provides communication between the intra-vane chambers 39. Axial openings 46 formed in the side of the rotor 25 extend to and intersect with the annular passage 44. A valving groove 45 is provided in each cheek plate and registers with openings 46. Fluid under pressure is supplied to the passage 44 by arcuate grooves 49 in each face of each cheek plate 16, 17. Each groove 49 extends about a portion of the travel of rotor 25. Grooves 49 are provided in the dwell zones in concentric relation to the grooves 45 for registry in the openings 46. A pressure balancing pad 48 is provided on the opposite face of the cheek plate and is circumscribed by a seal. An opening 50 extends through the plate and communicates each groove 49 with the pressure pad 48. As the axial openings 46 move across the arcuate grooves 49 the fluid pressure is transmitted to the intra-vane chambers 39 through the axial openings 46 and the annular passage 44. The fluid pressure is transmitted to the intra-vane chambers 39 and acts to move the vanes 36 radially outward and hold the reaction members 38 against the base of the under vane chamber 40.

Figure 5:
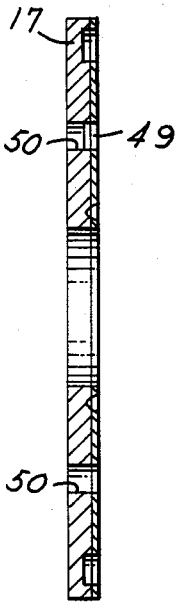
FIG. 5 is a sectional view taken along the line 5—5 in FIG. 4.
Figure 6:
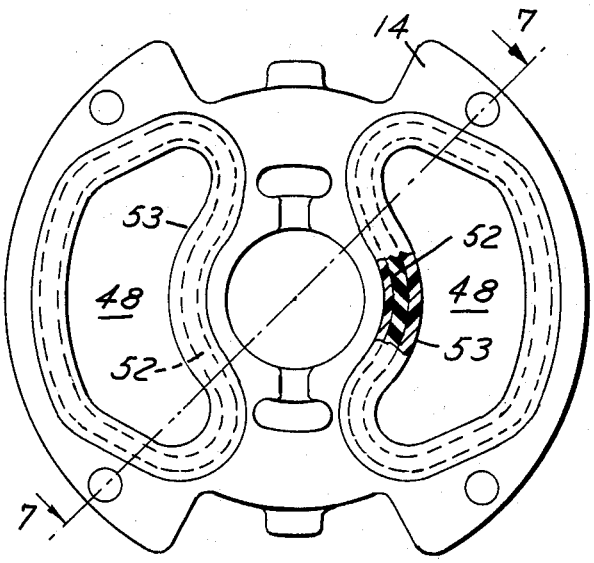
FIG. 6 is a sectional view taken along the line 6—6 in FIG. 1.

A pressure balancing pad 48 is provided on the opposite face of each cheek plate and is circumscribed by a seal (FIG. 6, 7). Each pressure balancing pad receives fluid from the associated fluid delivery port opening 33. An opening 50 extends through the plate (FIG. 5) and communicates each groove 49 with the pressure pad 48. Thus, when the vanes move from a low to a high pressure, fluid from the pressure balancing pad 48 equalizes the pressure so that the pressures on the cheek plate are balanced and supplied fluid to the openings 46 and in turn the passage 44 and vanes 36.

On the major dwell and inlet rise portions of the cycle, the grooves 41 function to maintain pressure at the inlet pressure. On the outlet fall portion of the cycle, grooves 41 function to increase the under vane pressure and retard the radially inward movement of the vanes to maintain the vanes in contact with the cam 13. On the minor dwell portion of the cycle between the outlet and the inlet zones, the grooves 41 function to communicate the outlet pressure at the outer ends of the vanes to the under vane area to assist in maintaining the vanes against the cam 13.

The pump is provided with an additional pair of arcuate grooves **45*a* in the cheek plates 16, 17 (FIGS. 3,4). The arcuate grooves 45*a* are positioned radially inward of arcuate grooves 45 so as to be intercepted by and in communication with the under vane chambers 40 as the rotor rotates. The arcuate grooves 45*a* span an arc leading from the outlet fall zone of the cam through the sealing zone just short of the inlet rise zone of the cam, thereby transmitting an additional supply of high pressure fluid to the under vane chambers as they travel through the sealing zone to maintain the tips of the vanes in contact with the cam. When the vanes move downwardly in the outlet fall zone, the grooves 45*a* throttle fluid being supplied by passages 41 to the under vane chambers 40 thereby maintaining the pressure in the under vane chambers at a pressure higher than the outlet pressure. On the minor dwell, grooves 45*a* provide fluid between adjacent under vane chambers 40** to assist in maintaining the vanes in contact with the cam.

Although the invention has been described as used in a pump, it can also be used in a motor of the sliding vane type.

Figure 9:
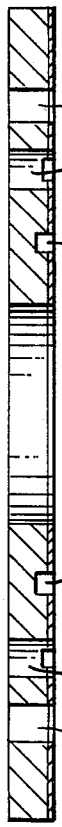
FIG. 9 is a sectional view taken along the line 9—9 in FIG. 8.
Figure 8:
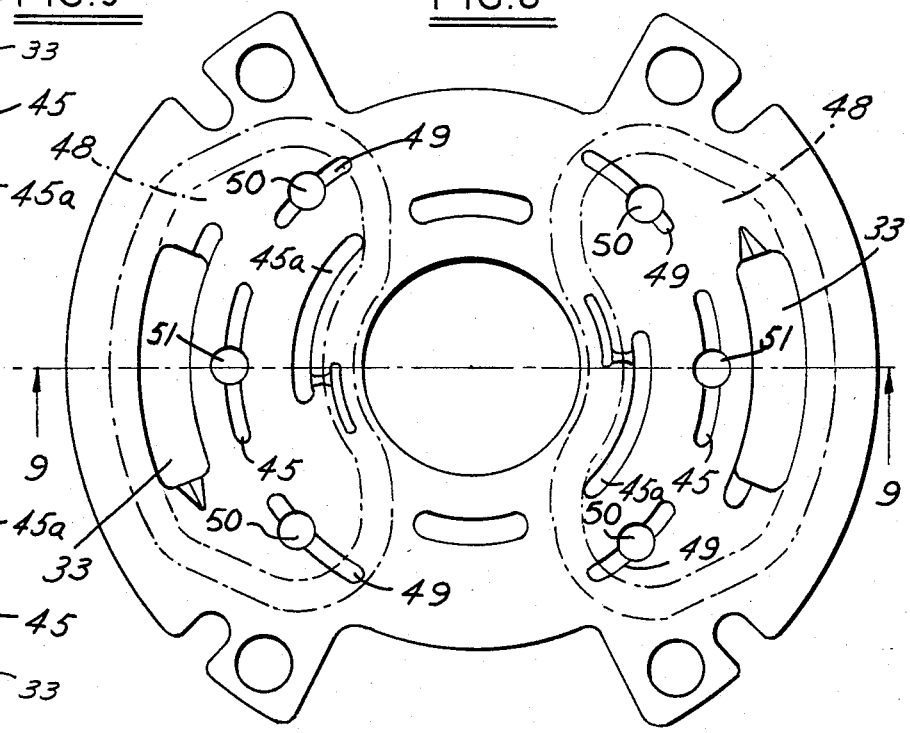
FIG. 8 is a fragmentary sectional view similar to FIG. 4 of a modified form of the invention.

In the modified form of the invention shown in FIGS. 8 and 9 which shows a cheek plate for a pressure energy translating device of larger capacity, the arcuate valving grooves 45 are also provided with openings 51 through the plate to provide a communication to the pressure pads. Grooves 45 thereby function to balance the cheek plates in the outlet zones.

Figure 7:
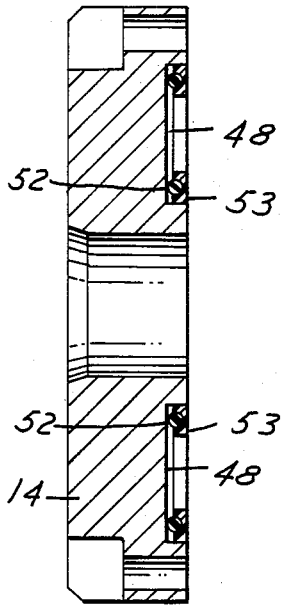
FIG. 7 is a view taken along the line 7—7 in FIG. 6.

As shown in FIGS. 6 and 7, the pressure pads 48 are defined by O-rings 52 in retainers 53 that circumscribe the area of the outlet 33, grooves 45, 45*a* and 49.

What is claimed is:

1. A fluid pressure energy translating device of the sliding vane type comprising a cam body including an internal contour, a rotor, a plurality of vanes rotatable with said rotor and slidable relative thereto in slots in the rotor, one end of each vane engaging said internal contour, said rotor and internal contour cooperating to define one or more pumping chambers between the periphery of the rotor and the cam contour through which the vanes pass carrying fluid from an inlet port to an outlet port, at least one cheek plate associated with said body and rotor, means forming two pressure chambers for each vane, each vane having two surfaces, one in each chamber, both being effective under pressure in said respective chambers to urge the vanes into engagement with the internal contour, a generally annular internal feed passage formed entirely within said rotor communicating with one set of said pressure chambers, each said vane having inner and outer ends and sides, the inner end of each said vane defining the surface of one of said pressure chambers, a radial passage on each said vane extending from the inner to the outer ends thereof, an arcuate valving groove formed in the cheek plate in an outlet fall zone or high pressure zone alongside said rotor, axial openings in said rotor extending from a side of said rotor to said annular passage and adapted to register with said arcuate valving groove as the rotor rotates relative to said cam body, an arcuate groove in the face of the cheek plate solely in the dwell zone, said arcuate groove being concentric with the arcuate valving groove and adapted to register with the chamber associated with the axial openings as the rotor rotates, and a hydrostatic pressure pad associated with the opposite face of the cheek plate and circumscribing the arcuate valving groove and the arcuate groove, an opening extending from the arcuate groove through the cheek plate to the hydrostatic pad area, said arcuate groove lying solely within said hydrostatic pressure pad.

2. The fluid energy translating device according to claim 1 including an additional arcuate groove formed in the cheek plate in communication with said chamber associated with the inner end of each said vane in the outlet zone.

3. The fluid energy translating device set forth in claim 1 including a second arcuate groove in the face of said cheek plate concentric with said arcuate valving groove such that the first arcuate groove and second arcuate groove are at opposite ends of said arcuate valving groove, and a second opening extending from the second arcuate groove to the hydrostatic pressure pad, said second arcuate groove being solely within the hydrostatic pressure pad.

* * * * *